US006589347B2

(12) United States Patent
Collin et al.

(10) Patent No.: US 6,589,347 B2
(45) Date of Patent: Jul. 8, 2003

(54) METHOD OF AND APPARATUS FOR THE APPLICATION OF ADHESIVE SPOTS TO INTERMITTENTLY TRANSPORTED OBJECTS

(75) Inventors: Jens Collin, Hamburg (DE); Martin Hoy, Hamburg (DE)

(73) Assignee: Topack Verpackungstechnik AG (DE)

( * ) Notice: Subject to any disclaimer, the term of this patent is extended or adjusted under 35 U.S.C. 154(b) by 114 days.

(21) Appl. No.: 09/829,938

(22) Filed: Apr. 11, 2001

(65) Prior Publication Data

US 2002/0022080 A1 Feb. 21, 2002

Related U.S. Application Data

(62) Division of application No. 09/323,139, filed on Jun. 1, 1999, now Pat. No. 6,235,350.

(30) Foreign Application Priority Data

May 29, 1998 (DE) ..... 198 24 007

(51) Int. Cl.[7] ..... B05C 11/00

(52) U.S. Cl. ..... 118/684; 118/687; 118/692

(58) Field of Search ..... 118/663, 665, 118/668, 679, 684, 686, 687, 692, 300, 669

(56) References Cited

U.S. PATENT DOCUMENTS 4,039,369 A 8/1977 Versteege
4,530,862 A * 7/1985 Kerzel ..... 118/669
4,957,782 A * 9/1990 Medler et al. ..... 118/300
5,201,973 A * 4/1993 Castaldo et al. ..... 118/669
5,479,352 A 12/1995 Smith
5,588,996 A 12/1996 Costello
6,129,040 A 10/2000 Viggiano et al.

FOREIGN PATENT DOCUMENTS

DE 37 28 054 3/1989
DE 38 22 835 3/1990
JP 4-200773 7/1992

* cited by examiner

*Primary Examiner*—Richard Crispino
*Assistant Examiner*—Yewebdar Tadesse
(74) *Attorney, Agent, or Firm*—Venable LLP; Robert Kinberg; Catherine M. Voorhees

(57) ABSTRACT

The application of (for example, elongated strip-shaped) spots of adhesive paste to successive objects (such as paper or cardboard blanks which are to be converted into soft or hinged-lid packs for arrays of cigarettes) which are advanced stepwise below the nozzle or nozzles of one or more pasters at an adhesive-applying station is regulated by a control unit which receives signals denoting the speed of the conveyor for the objects and the position of the object at the adhesive-applying station. The control unit regulates the operation of the valve for each nozzle of the paster by taking into consideration the inertia of electrical and mechanical constituents of the paster. This ensures the application of spots having an optimum shape and an optimum position relative to the respective objects and containing predetermined quantities of adhesive. The control unit ascertains a compensation interval for the inertia which is added to or subtracted from a system-dependent correction interval which reflects the pattern of advancement of the objects.

10 Claims, 1 Drawing Sheet

METHOD OF AND APPARATUS FOR THE APPLICATION OF ADHESIVE SPOTS TO INTERMITTENTLY TRANSPORTED OBJECTS

CROSS-REFERENCE TO RELATED CASES

This application is a divisional of U.S. Ser. No. 09/323,139 filed Jun. 1, 1999 now U.S. Pat. No. 6,235,350 and claims the priority of German patent application Serial No. 198 24 007.4 filed May 29, 1998, the disclosure of both the foregoing documents, as well as that of each US and foreign patent and patent application mentioned in the specification of the present application, being incorporated herein by reference.

BACKGROUND OF THE INVENTION

The invention relates to improvements in methods of and in apparatus for the application of adhesive spots or patches to intermittently transported objects, such as a series of successive blanks of paper, cardboard, plastic or the like. More particularly, the invention relates to improvements in methods of and in apparatus for applying (e.g., by one or more nozzles or analogous implements) spots or patches of adhesive to a succession of objects which are being advanced in stepwise fashion and in accordance with a predetermined pattern, preferably as regards the extent, the frequency and/or the rate of movement of successive objects along a predetermined path. Examples of objects which are being advanced or transported in the above outlined manner are blanks which are utilized in the tobacco processing industry for conversion into packs or other types of receptacles for smokers' products, e.g., for arrays of plain or filter cigarettes, cigars, cigarillos or analogous rod-shaped products.

It is customary to employ valve-controlled nozzles in pasters which serve to apply (preferably or desirably) equal quantities of a suitable adhesive in various types of machines which are utilized in the tobacco processing industry. Patches, spots or continuous or interrupted strips of a suitable adhesive can be utilized for the making of longitudinal seams including the overlapping marginal portions of converted webs (envelopes or wrappers) of cigarette paper, tipping paper or the like. Those parts which are utilized to initiate or terminate the application of an adhesive to successive blanks of cigarette paper or the like (such parts can include, for example, mobile constituents of valves and/or valve-controlled nozzles) are invariably influenced by inertia which must be taken into consideration if the application of adhesive spots is to take place with a required or desired degree of predictability, uniformity and reproducibility. In other words, it is desirable and necessary to include, into the calculation of intervals during which a nozzle is to actually discharge adhesive from a suitable source onto successive objects of a series of successive objects, the intervals of succesive alternating accelerations and decelerations of the conveyor system for the series of objects as well as the intervals which elapse between successive assumptions by the valve or valves of its or their fully open and fully closed positions.

When the application of an adhesive is to take place in certain branches of the tobacco processing industry, the accuracy and predictability of such application are greatly influenced by the continuously increasing frequency at which the objects which are to receive spots or patches of adhesive must be advanced toward, past and beyond one or more adhesive applying stations. For example, patches of adhesive must be applied to selected portions of blanks which are to be converted into so-called soft or hinged-lid packs for arrays of cigarettes or the like. The patches must be applied to various tucks and/or flaps and/or panels and/or lids and/or walls in order to ensure that each adhesive-coated part will reliably adhere to a neighboring part when the conversion of a blank into a packet confining an array of cigarettes or the like is completed.

Presently known proposals to compensate for inertia of moving parts in the conveyor system and/or in the adhesive applying system for a series of objects (such as blanks of paper, cardboard or the like and hereinafter called blanks for short) include the resort to a preliminary or advance regulation. Such regulation takes into consideration certain specific values which are characteristic of moving parts (e.g., in a valve) and of their inertia in dependency upon various parameters, such as the nature and consistency of the adhesive, the pressure, the temperature and/or certain other variables. This is intended to ensure that, if the rate of transport of the blanks is at least substantially constant, the dimensions, the shapes and the locations of successively applied adhesive spots will at least approximate the desired values.

It has been ascertained that the presently known proposals to accurately meter the application of adhesive under the above outlined circumstances are often unsatisfactory, especially when accurately defined spots containing predetermined (optimum) quantities of a selected adhesive (e.g., a pasty adhesive) are to be applied to intermittently advanced blanks which are repeatedly accelerated, moved at full speed and thereupon decelerated at a high frequency, e.g., as required in a modern high-speed cigarette packing machine.

OBJECTS OF THE INVENTION

An object of the invention is to provide a method which ensures a highly predictable application of optimum quantities of an adhesive under circumstances which do not permit a sufficiently accurate distribution of optimum quantities of adhesive by resorting to heretofore known methods.

Another object of the invention is to provide a method which renders it possible to take into consideration all variables, or all relevant or important variables, which influence the rate of application of an adhesive paste during opening and closing of the valve or valves which is or are used to regulate the outflow of adhesive through the orifices of nozzles or analogous adhesive-dispensing implements.

A further object of the invention is to provide a relatively simple and readily practicable method which can be rapidly adapted to the desired or required circumstances of application of a selected adhesive.

An additional object of the invention is to provide a novel and improved apparatus for the practice of the above outlined method.

Still another object of the invention is to provide the apparatus with novel and improved controls for the device or devices which effect the dispensing of spots or patches of adhesive onto intermittently advancing objects in the form of paper or cardboard blanks or the like.

A further object of the invention is to provide novel and improved controls for the valve or valves which is or are utilized in the above outlined apparatus.

Another object of the invention is to provide a cigarette packing machine which embodies one or more apparatus of the above outlined character.

SUMMARY OF THE INVENTION

One feature of the present invention resides in the provision of a method of applying spots of adhesive to objects of a series of objects. The method comprises the steps of advancing the objects in a stepwise fashion in accordance with a pattern wherein a phase of zero speed is followed by a phase of acceleration, by a phase of advancement at an at least substantially constant speed and by a phase of deceleration back to zero speed, and discharging adhesive onto successive objects of the series (preferably by a nozzle of a valve including constituents having electrical and mechanical inertia) for periods of time ascertained on the basis of a plurality of parameters including a compensation interval for the inertia and a correction interval reflecting the pattern of advancement of the objects.

The method can further comprise the steps of monitoring at least the acceleration and deceleration phases of the pattern of advancement of the objects, generating signals denoting the monitored acceleration and deceleration phases, utilizing such signals to ascertain (e.g., to calculate) the correction interval, adding the correction interval to the compensation interval to thus determine the duration of the deceleration phase, and subtracting the correction interval from the compensation interval to thus determine the duration of the acceleration phase.

The advancing step can include placing the objects onto a stepwise advancing conveyor, and the monitoring step can include monitoring the speed of the conveyor.

The method including the just mentioned step can further comprise the step of monitoring the positions of objects on the conveyor.

The objects can comprise or constitute blanks (e.g., paper, cardbord and/or plastic blanks) of wrapping material.

The advancing step can comprise transporting the objects along an at least substantially horizontal path.

The method can further comprise the steps of establishing a source of adhesive, establishing a flow of adhesive from the source to the valve, and regulating the pressure of adhesive in the flow.

The discharging step can include applying to each object at least one elongated (e.g., rectangular) spot of adhesive.

Another feature of the invention resides in the provision of an apparatus for applying patches or spots of adhesive to successive objects of a series of objects. The improved apparatus comprises means for advancing the objects of the series in a stepwise fashion in accordance with a pattern wherein a phase of zero speed is followed by a phase of acceleration, by a phase of advancement at an at least substantially constant speed and a phase of deceleration back to zero speed. The apparatus further comprises at least one paster including an adjustable valve and a nozzle arranged to discharge spots or patches of adhesive onto successive objects on the advancing means (the valve includes constituents having electrical and mechanical inertia), and control means for the valve. In accordance with a presently preferred embodiment, the control means preferably includes means for causing the nozzle to discharge adhesive for periods of time which are ascertained as a function of a plurality of parameters including a compensation interval for the inertia and a correction interval reflecting the aforementioned pattern of advancement of the objects.

The control means can further comprise means for monitoring the advancement of objects and means for monitoring the positions of the objects relative to the nozzle during the application of adhesive to an object.

The apparatus can further comprise means for monitoring the rates of speed during the acceleration and deceleration phases and for transmitting signals to the control means.

Still further, the apparatus can comprise a source of adhesive, means for conveying adhesive from the source to the valve along a predetermined path (e.g., in a conduit), and means for regulating the pressure of adhesive in such path. The control unit can be arranged to determine the pressure of fluid in the path by way of the regulating means.

The novel features which are considered as characteristic of the invention are set forth in particular in the appended claims. The improved apparatus itself, however, both as to its construction and its mode of operation, together with numerous additional important features and attributes thereof, will be best understood upon perusal of the following detailed description of certain presently preferred specific embodiments with reference to the accompnying drawings.

DESCRIPTION OF PREFERRED EMBODIMENTS

Figure 1:
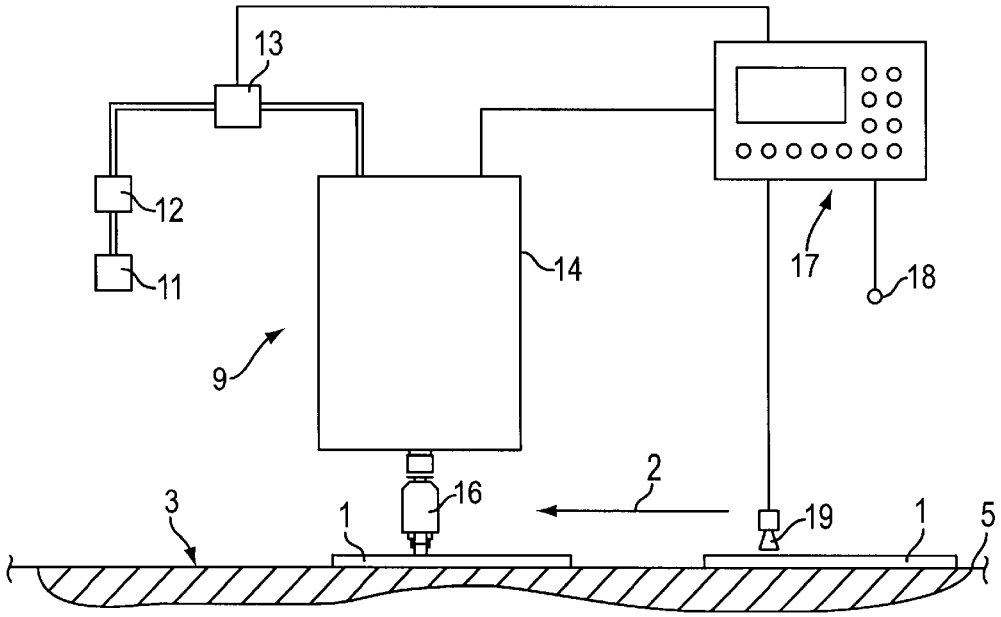
FIG. 1 is a schematic elevational view of an apparatus which embodies one form of the invention and is utilized in a cigarette packing machine to apply several spots or patches of adhesive to each of a series of successive blanks which are to be converted into packs for cigarettes or other rod-shaped articles.

FIG. 1 shows an apparatus which is designed to apply spots or patches 8 (see FIG. 2) of adhesive to a series of successive paper, cardboard or plastic blanks 1 prior to conversion of such blanks into the envelopes or packs of packets (not shown) of plain or filter cigarettes or the like. The means for advancing or transporting the blanks 1 sideways (arrows 2) along a horizontal or substantially horizontal path 3 comprises a suitable conveyor 5, e.g., an endless belt or chain conveyor. The apparatus of FIG. 1 can be put to use in a cigarette packing machine, e.g., in a machine known as CHRONOS and distributed by the assignee of the present application.

Figure 2:
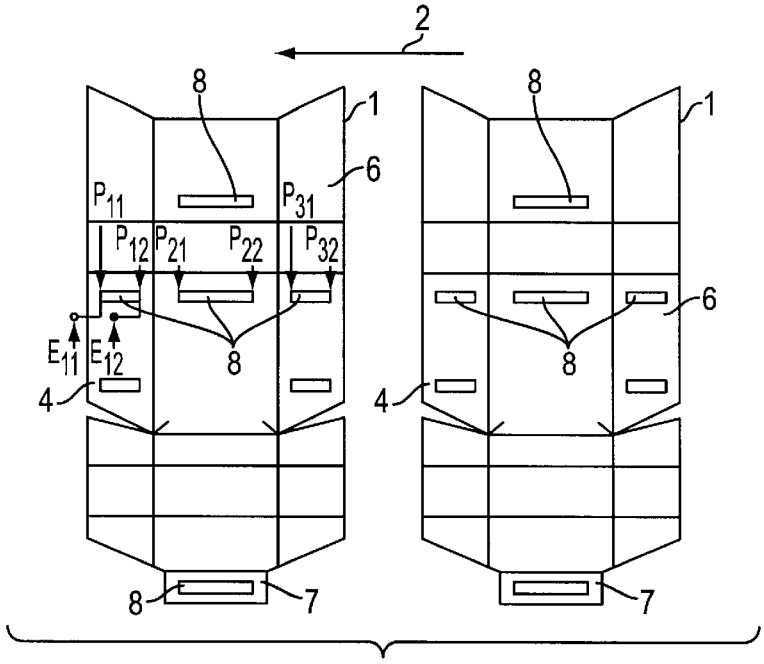
FIG. 2 is a plan view of two neighboring blanks and of adhesive spots adapted to be applied thereto by the apparatus of FIG. 1.

The conveyor 5 is operated intermittently, i.e., in a stepwise fashion, and the apparatus is designed to apply one or more spots 8 of adhesive during each period of dwell of the conveyor, to the upper side of the blank 1 which is then located below the orifice(s) of one or more nozzles 16 forming part of the improved apparatus. Each of the two blanks 1 which are shown in FIG. 2 has three neighboring panels 4, 7, 6 which are pivotable relative to each other along elongated fold lines extending transversely of the direction indicated by the arrows 2. The relatively wide median panel 7 of each blank 1 must receive three relatively long parallel strip-shaped spots 8 which extend transversely of the respective blank, i.e., in the direction indicated by the arrows 2; and each of the two relatively narrow panels 4, 6 must receive two relatively short parallel rectangular spots 8. The median spot 8 on the median panel 7 is aligned with a short spot 8 on each of the respective outer panels 4, 6.

The nozzle 16 which is shown in FIG. 2 forms part of a paster 9 which is assumed to be set up for the application of single elongated spots on successive blanks 1, for the application of three elongated spots 8 including a single long spot and two short spots, or for the application of two short spots. The paster 9 of FIG. 1 further comprises a source 11 of adhesive (e.g., a suitable receptacle), a conveying unit 12 which causes the adhesive to advance from the source 11 toward a valve 14 carrying the nozzle 16, and an adjustable pressure regulator 13 installed in a conduit forming part of the conveying unit and being installed between the conveying unit and the nozzle. The latter serves as a means for applying a suitable adhesive (e.g., a hotmelt) to form rows of three aligned spots or patches 8 on successive blanks 1 being intermittently advanced by the conveyor 5.

The apparatus including the structure shown in FIG. 1 can comprise four nozzles 16 which are spaced apart from each other in a direction transversely of that indicated the arrow 2, i.e., at right angles to the longitudinal extension of the path 3 defined by the conveyor 5. Each of the four nozzles 16 is controlled by a discrete valve 14.

The upper spot 8 on the panel 4 of the left-hand (downstream) blank 1 shown in FIG. 2 has a leading end P11 and a Wailing end P12 (as seen in the direction indicated by the arrows 2); the median spot 8 in the same row of three successive spots has a leading end P21 and a trailing end P22, and the upper spot 8 on the panel 6 of the same blank 1 has a leading end P31 and a trailing end P32. The lengths of the three aligned spots 8 on the panels 4, 7, 6 of successive blanks 1 are determined by an electronic control unit or regulating unit 17 for the valve 16 and the pressure regulator 13. The control unit 17 (such as an electronic circuit) takes into account the mechanical and/or electrical inertia of the valve 14 and its nozzle 16 by initiating an actuation of the valve at the instant E11 (i.e., ahead of the leading end P11) and by terminating the actuation of the valve at the instant E12.

The compensation interval t1 which elapses between the instants E11 and E12 is selected in such a way that it suffices for the application of the upper spot 8 on the panel 4 of the front or leading (left-hand) blank 1 of FIG. 22. Such mode of controlling the operation of the valve 14 and of the associated nozzle 16 ensures the application of spots 8 having a predictable length (i.e., a predictable quantity of adhesive) and a predictable position relative to the respective panel (namely the panel 4 of FIG. 2) as long as the phase of acceleration of the blanks, the immediately following phase of movement at a predetermined speed, and the immediately following phase of deceleration to zero speed follow or form part of a predetermined pattern, i.e., as long as the timing of initial opening of the valve 14, the following retention of the valve in open position, and the following closing of the valve are or remain synchronized with the movements of the conveyor 3 and the blanks 1 thereon.

The condition of the valve 14 is changed in response to electric signals from the control unit 17. The timing of changes is such that a signal to initiate the operation (opening) of the valve 14 at the instant Ellis followed by a first interval which elapses before the nozzle 16 actually proceeds with the application of adhesive (at P11). Such first interval is followed by a second interval between P11 and P12 during which the actual application of adhesive takes place. The second interval elapses (at P12) subsequent to elapse of a third interval which starts at E11 and ends at E12; this third interval represents the duration of actuation of the valve 14 whereas the second interval represents the duration of actual application of adhesive to form a spot or patch 8 having a leading end P11 and a trailing end P12.

Analogous (but not necessarily identical) circumstances arise during the application of the next (longer) spot 8, namely the median spot on the median panel 7 of the left-hand blank 1 shown in FIG. 2. This is achieved by equipping the control unit 17 with all necessary sensors which monitor the acceleration, deceleration, movements at a constant speed, and periods of standstill of the conveyor 3. Signals from such sensors are transmitted to the signal processing stage or stages of the control unit 17, and the resulting output signal is used to control the operation of the valve 14 and the associated nozzle 16.

The reference character 18 denotes in FIG. 1 an indexible incremental sensor which monitors the speed of a rotary component (e.g., a pulley or a sprocket wheel) of the conveyor 5 and transmits to the signal processing stage(s) of the control unit 17 signals denoting the speed and variations of speed of the conveyor 5. A radiation (such as light-) sensitive sensor 19 transmits to the signal processing stage (s) of the control unit 17 signals denoting the detected arrival of a blank 1 at the adhesive applying station, i.e., into the range of the paster 9. For example, the color or shade or finish and/or another characteristic of the conveyor 5 can be such that the sensor 19 can reliably detect the arrival of the leading (left-hand) edges of successive blanks 1 on the conveyor, and the signals from the sensor 19 to the signal processing stage(s) of the control unit 17 are utilized (with the signals from the sensor 18) to ensure an accurate timing of opening and closing of the valve 14 in order to guarantee the application of patches having a predictable length and a predictable (optimum) position on the exposed side of the respective blank 1, and containing a predetermined (requisite) quantity of adhesive. The control unit 17 ascertains the necessary correction intervals tG which reflect the pattern of advancement of the blanks 1. The aforementioned compensation intervals t1 account for the electrical and mechanical inertia of the parts (of the valve 14 and nozzle 16) involved in the selection of the shapes, positions and masses of the spots 8.

The control unit 17 can be designed to calculate the duration of the aforediscussed first, second and third intervals. For example, the correction interval tw (denoting the acceleration or deceleration of the application of adhesive) can be ascertained in accordance with the equation tw=t1+tG. Once the inertia of the paster 9 is known, it is relatively simple to set the valve 14 and the associated nozzle 16 for the purpose of forming spots 8 of desired size and/or shape, as well as to properly locate each spot 8 relative to the marginal portions of the respective panel 4, 6 or 7.

The valve 14 and the associated nozzle or nozzles can be commercially available components. For example, the apparatus of FIG. 1 can employ a valve-nozzle combination known as "Valco 400 E" (distributed by the German subsidiary (located at Enger, Federal Republic Germany) or Valco, Inc. located at Cincinnati, Ohio).

An important advantage of the improved method and apparatus is that the interval tw of effective acceleration or deceleration of paste application is no longer dependent upon the valve 14 but rather on the onset and termination of adhesive application. Otherwise stated, the compensation (t1) for electrical and mechanical inertia is dependent upon the characteristics of the spots or patches 8. On the other hand, the direction and the extent of variation of speed determine the correction interval tG which, in turn, can be resorted to for a reliable determination of the interval tw. Thus, tG is subtracted from t1 during acceleration of adhesive application, and tG is added to t1 during deceleration of adhesive application.

The interval tw further reflects departures (if any) of the positions of blanks 1 at the adhesive applying station from the preselected or predetermined or anticipated positions. This is particularly desirable when the positions of the blanks 1 are determined indirectly by incremental pickups or gauges in the machine wherein the improved apparatus is being put to use. As already explained hereinbefore, the improved apparatus can be utilized in cigarette packing machines.

Another advantage of the improved method and apparatus is that one and the same valve 14 and the associated nozzle 16 can ensure highly accurate (i.e., highly predictable) application of two or more successive spots 8 on one and the same blank 1 within any one of the cycles of adhesive application.

Still another advantage of the improved method and apparatus is that the times or intervals t1 selected by the manufacturer of the valve 14 and its nozzle 16 must only be supplemented by the prevailing specific position-dependent intervals or times tw which are dependent upon the selected mode of operation (acceleration, deceleration, the length of the intervals of movement at constant speed and the duration of the periods of idleness) of the conveyor 3 which is utilized to advance the objects (such as the blanks 1) that are to receive spots or patches of a suitable adhesive. This renders it possible to rapidly exchange or replace the valve 14 and the associated nozzle 16.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

What is claimed is:

1. An apparatus for applying spots of adhesive to intermittently advanced, successive objects of a series of objects, comprising:

means for advancing the objects of the series in a stepwise fashion in accordance with a predetermined pattern wherein a phase of zero speed is followed by a phase of acceleration, by a phase of advancement at an at least substantially constant speed and a phase of deceleration back to zero speed;

means for monitoring rates of speed of the objects during at least the acceleration and deceleration phases and for calculating a correction interval as a function of the direction and extent of variation of speed during the acceleration and deceleration phases, respectively;

at least one paster including an adjustable valve and a nozzle arranged to discharge spots of adhesive onto intermittently advanced, successive objects on said advancing means, said valve including constituents having electrical and mechanical inertia; and control means for causing said nozzle to discharge adhesive onto intermittently advanced, successive objects of the series of objects for periods of time ascertained as a function of a plurality of parameters including a compensation interval $t_1$ for said inertia and a correction interval $t_g$ reflecting said pattern of advancement of the objects where the compensation interval $t_1$ is adjusted by the correction interval $t_g$ so as to compensate for the inertia of the constituents in the valve during the phases of acceleration and deceleration.

2. The apparatus of claim 1, wherein said control means further comprises means for monitoring the advancement of objects and means for monitoring the positions of objects relative to said nozzle during the application of adhesive to an object.

3. The apparatus of claim 1, further comprising means for monitoring the rates of speed during said acceleration and deceleration phases and for transmitting signals to said control means.

4. The apparatus of claim 1, further comprising a source of adhesive, means for conveying adhesive from said source to said valve along a predetermined path, and means for regulating the pressure of adhesive in said path.

5. The apparatus of claim 4, wherein said control means is arranged to determine the pressure of fluid in said path by way of said regulating means.

6. An apparatus for applying spots of adhesive to successive packaging components for tobacco products of a series of such components, comprising:

means for advancing the components in a stepwise fashion in accordance with a predetermined pattern wherein a phase of zero speed is followed by a phase of acceleration, by a phase of advancement at an at least substantially constant speed and a phase of deceleration back to zero speed;

means for monitoring rates of speed of the components during at least the acceleration and deceleration phases and for calculating a correction interval $t_g$ as a function of the direction and extent of variation of speed during the acceleration and deceleration phases, respectively;

at least one paster including an adjustable valve and a nozzle arranged to discharge spots of adhesive onto successive components on the advancing means, the valve including constituents having electrical and mechanical inertia; and control means for the valve for causing the nozzle to discharge adhesive onto successive components of the series of components for periods of time ascertained on the basis of a plurality of parameters including a compensation interval $t_1$ for said inertia adjusted by the correction interval $t_g$ so as to compensate for the inertia of the constituents in the valve during the phases of acceleration and deceleration.

7. The apparatus of claim 6, wherein the control means adjusts the compensation interval $t_1$ with means for adding said correction interval $t_g$ to said compensation interval $t_1$ during said deceleration phase, and means for subtracting said correction interval $t_g$ from said compensation interval $t_1$ during said acceleration phase.

8. The apparatus of claim 6, wherein the monitoring means is for monitoring the advancement of components and for monitoring the positions of components relative to the nozzle during the application of adhesive to a component.

9. The apparatus of claim 6, further comprising a source of adhesive, means for conveying adhesive from the source to the valve along a predetermined path, and means for regulating the pressure of adhesive in the path.

10. The apparatus of claim 6, wherein the control means is arranged to determine the pressure of fluid in the path via the regulating means.

* * * * *